United States Patent [19]

Köbler

[11] Patent Number: 4,557,196

[45] Date of Patent: Dec. 10, 1985

[54] PRINTING PLATE ATTACHMENT ARRANGEMENT

[75] Inventor: Ingo Köbler, Anhausen, Fed. Rep. of Germany

[73] Assignee: M.A.N.-Roland Druckmaschinen Aktiengesellschaft, Offenbach am Main, Fed. Rep. of Germany

[21] Appl. No.: 674,994

[22] Filed: Nov. 26, 1984

[30] Foreign Application Priority Data

Dec. 15, 1983 [DE] Fed. Rep. of Germany ..... 3345369

[51] Int. Cl.[4] ..... B41F 1/28

[52] U.S. Cl. ..... 101/415.1

[58] Field of Search ..... 101/382 R, 383, 415.1

[56] References Cited

U.S. PATENT DOCUMENTS

| | | | |
|---|---|---|---|
| 1,614,801 | 1/1927 | Osterlind | 101/415.1 |
| 2,121,309 | 6/1938 | Wale | 101/415.1 |
| 2,209,127 | 7/1940 | Lowe | 101/415.1 |
| 2,229,133 | 1/1941 | Sands | 101/383 |
| 3,011,437 | 12/1961 | Hartmann | 101/415.1 |
| 3,191,532 | 6/1965 | Hermach et al. | 101/415.1 |
| 3,353,481 | 11/1967 | Antonucci | 101/382 R |
| 3,534,694 | 10/1970 | Tafel et al. | 101/415.1 |
| 4,223,604 | 9/1980 | Brehm et al. | 101/383 |

FOREIGN PATENT DOCUMENTS

| | | | |
|---|---|---|---|
| 640262 | 12/1936 | Fed. Rep. of Germany | 101/415.1 |
| 1611416 | of 1948 | Fed. Rep. of Germany | 101/415.1 |
| 2823776 | 12/1979 | Fed. Rep. of Germany | 101/415.1 |
| 526837 | 3/1939 | United Kingdom | 101/415.1 |

*Primary Examiner*—E. H. Eickholt

*Attorney, Agent, or Firm*—Frishauf, Holtz, Goodman & Woodward

[57] ABSTRACT

To secure a thin, flexible printing plate (4) on the circumference of a plate cylinder (2, 20) by inserting the ends of the printing plate into two narrow parallel slits, the printing cylinder has a groove (3, 21) cut therein in which an insert strip (5, 23) is located which has an inner guide portion (6, 24) fitting within the groove, and a projecting engagement or separating wall portion (9, 25) which is narrower than the guide portion, the walls of the engagement or separating wall portion defining, together with the walls of the groove, the respective slits (18, 30) in which the ends of the printing plate can be inserted. The strip can be irremovably adhered to the cylinder in the groove, or can be made axially slidable, for example under control of a worm (27) engaging in the teeth, so that the lateral register of the printing plate wrapped about the circumference of the cylinder can be adjusted, the printing plate engaging suitable abutment strips or pins (13, 31) formed on the insert strip.

11 Claims, 3 Drawing Figures

PRINTING PLATE ATTACHMENT ARRANGEMENT

The present invention relates to an arrangement to attach a thin, flexible printing plate on the plate cylinder of a printing machine.

BACKGROUND

It has previously been proposed to cut two narrow slots, parallel to the axis of a plate cylinder, into its circumference. The slots extend at an angle with respect to the tangent of the outer circumference of the plate cylinder, at the point of intersection of the slot with the surface. The slots are arranged to receive respective ends of the printing plate.

German Utility Model Publication DE-GM No. 16 11 416 describes an arrangement to secure a metal foil on the cylinder of a duplicating machine. The structure is characterized by its simplicity—which, however, is not the case with respect to its manufacture. Forming two parallel slits, of very small width dimension, is difficult. The slits must be narrow so that the ends of the metal foil can be reliably secured. Manufacture of such slits must be done with material removing tools, in which the cut must be made at an inclination to the surface of the cylinder. The cut must be made accurately, since the slits must be precisely parallel to the axis of the cylinder.

While it is possible to make slits of this type in cylinders of the limited length used in copy machines, or duplicating machines, it is practically impossible to make slits of this type in the much larger and substantially longer cylinders used in printing machines which, for example, are employed in newspaper printing and the like. The cost of making such slits, of the small width required, which extend precisely parallel to the axis of the cylinder, is excessive.

THE INVENTION

It is an object to provide an attachment arrangement for a flexible printing plate to place the printing plate about a printing cylinder, in which the cost of making narrow slits in the printing cylinder, which extend precisely parallel to the axis of the cylinder, is substantially reduced over that if methods used in connection with making small, duplicating or copy machine cylinders, are used.

Briefly, a groove is formed in the circumference of the plate cylinder at the required angle which, however, is substantially larger, that is, substantially wider, and also deeper than the desired slits. The width of the groove must be larger than twice the thickness of the printing plate; in actual practice, it is substantially larger. An insert strip is then placed in the groove, and retained therein, the insert strip having a guide portion located at the root or bottom of the groove, engaging the walls of the groove. The strip is reduced in thickness in the region of the slits, leaving a free space between the strip and the walls of the groove which then form the narrow slits.

The strip can be retained in the groove by adhesion or by other well known elements, such as screws, holding clips or the like.

The arrangement has the advantage that register or locating projections, pins or other elements which, preferably, are positioned within the slits, can readily be formed on the strip, before its insertion, so that such register arrangements can be easily introduced—whereas, if a slit is to be cut into a cylinder, placement of such register elements within cut narrow slits is practically impossible. By making the slit axially movable, for example under control of a worm gear engaging projections or teeth formed on the inner side of the strip, it is possible to adjust the axial register of a printing plate placed on the cylinder even after its insertion.

DRAWINGS

DETAILED DESCRIPTION

Figure 1:
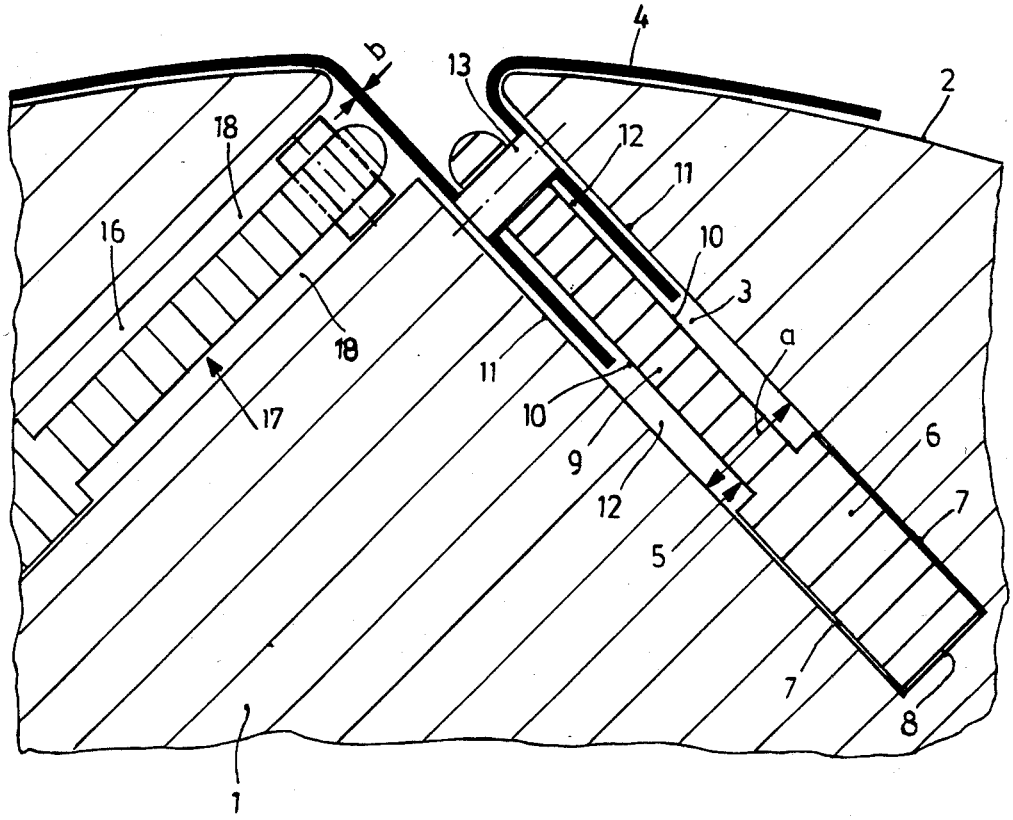
FIG. 1 is a fragmentary axial sectional view through a printing cylinder and having the attachment arrangement in accordance with the present invention.

A plate cylinder 1 has a groove 3 cut at an angle with respect to the cylindrical surface 2 of the plate cylinder. The groove 3 extends parallel to the axis of the plate cylinder and extends over the entire width of a printing plate 4 to be secured to the circumference of the plate cylinder 1. The groove 3 has a width a which is wider than twice the thickness b of the printing plate. Preferably, it is substantially wider, for example about 8 to 10 times as wide as the thickness of the printing plate; in one illustrative example, the printing plate has a thickness b of about 0.25 mm; for such a printing plate, the groove 3 has a width a of about 2 mm.

The narrow slits to receive the printing plate are defined by an insert strip 5 which extends over the entire length of the groove 3. The groove 3 may extend in the printing cylinder essentially from end to end. The insert strip 5 has a guide portion 6 which engages the lower region 7 of the side walls which define the groove 3 as well as the root or bottom 8 of the groove; thus, the guide portion 6 is located within the inner end of the groove. The insert strip 5 further includes a separating wall 9 which extends up to just about the upper end of the groove 3. The two side walls 10 of the upper end portion 9 extend parallel to the upper region 11 of the side walls which define the groove 3. The separating portion or separating wall 9 is slightly narrower than the width of the groove, leaving between the side walls 10 and 11 the narrow slit 12 into which the respective ends of the printing plate 4 can be inserted.

The insert strip 5 can be positioned in the groove 3 in various ways, for example by adhesion, with a suitable adhesive such as epoxy or the like, bonding the guide element 6 to the inner region 7 of the groove and to the bottom 8 thereof. Other connections may be used, for example attachment by screws or the like.

Figure 3:
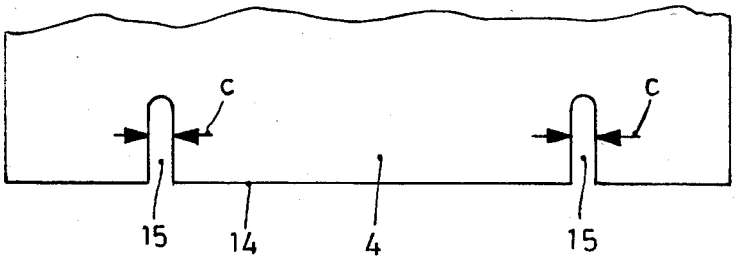
FIG. 3 is a fragmentary top view of a printing plate showing register notches formed therein.

Two pins 13—of which only one is shown in FIG. 1—pass through the separating wall portion 9 of the insert strip 5. The pins are securely connected to the wall 9, and the length of the pins 13 is slightly less than the width a of the groove. The pins 13 can be readily inserted into the groove 3 together with the insert strip 5. The pins 13 are used to maintain lateral register of the printing plate 4, and to insure maintenance of this register. The printing plate 4—see FIG. 3—is formed at the front and rear end portions with notches 15 in the edge 14 thereof. The width c of the notches corresponds to the diameter of the pins 13.

In some machines, the plate cylinder may rotate in either direction, which then will require locating the printing plate such that its angle of inclination, at the exit of the groove, extends, selectively, towards the right or the left. FIG. 1 illustrates, in abbreviated form, a second groove 16 which can be the mirror image of groove 3. Groove 16 has a further insert strip 17 secured therein which defines two slits 18 with the inner walls of the groove. The arrangement is mirror-image identical to that described in connection with the right side of FIG. 1.

Figure 2:
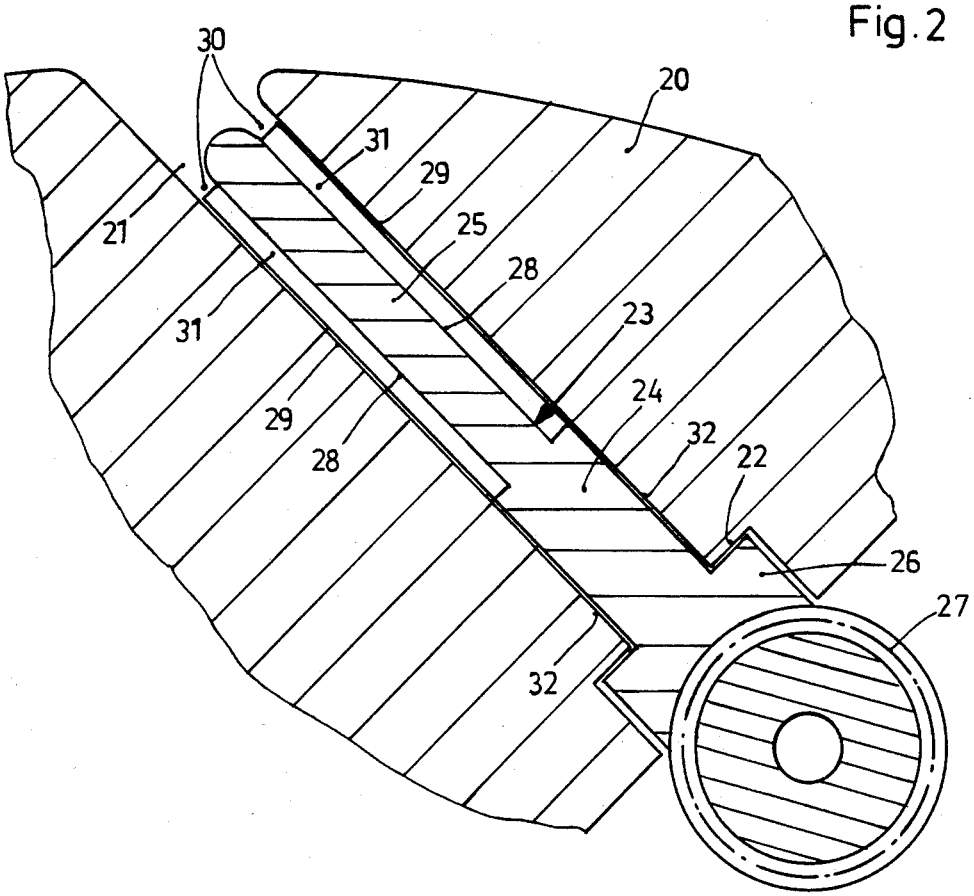
FIG. 2 is a fragmentary view of a printing cylinder with a modified embodiment of the attachment arrangement.

In accordance with a feature of the invention, the lateral register of the printing plate 4 can be adjusted if the embodiment of FIG. 2 is used. A plate cylinder 20 has a groove 21, corresponding to the groove 3 cut therein, which is formed at its inner end with an enlarged portion 22. The groove 21 has an insert strip 23 inserted therein which, as before, includes a guide portion 24 and a separating or engagement portion 25. The guide portion 24 is enlarged at its inner end, as seen at 26, and formed, interiorly of the cylinder, with projections, typically teeth, which engage a worm wheel 27. The worm 27 is shown only schematically, and may be of any suitable construction, engaging the teeth of the enlarged portion 26. Upon rotation of the worm 27—which is restrained against axial shifting—the insert strip 23 will be moved axially with respect to the cylinder to thereby permit axial register adjustment of a printing plate secured to the circumference thereof—not shown in FIG. 2.

The lateral sides 28 of the separating wall or projection 25, together with the upper regions 29 of the side walls of the groove 21, define respective slits 30 to receive the ends of a printing plate. The separating wall 25 includes two longitudinal strips 31 which form register abutments and, together with the notches 15 in the printing plate, insure lateral register thereof.

The insert strip 25 can be shifted parallel with respect to the axis of the plate cylinder 20 within the groove 21. The guide element 24 engages the side walls of the groove 21 in the inner region 32 of the groove. By rotation of the worm 27, the insert strip 23 can be shifted parallel to the axis of the cylinder 20 within the groove 21. Since the lateral abutment strips 31 follow with the insert strip 23, a plate secured to the circumference of cylinder 20 and located between the abutment strips 31 will be shifted axially.

The insert strip 23 can be held in position by any suitable means, not shown, such as, for example, a loop or the like surrounding a cylindrical portion or cylindrical portions of the worm 27, besides being guided by the enlargement 26 fitting against the shoulder 22 in the interior of the groove 21.

Various changes and modifications may be made, and any features described herein may be used with any of the others within the scope of the inventive concept.

The width a of the grooves 3, 21 is, preferably, between about 5 to 10 times the thickness b of the printing plate, preferably at least 6 times this thickness; the maximum dimension will be governed by availability of cutting tools and the accuracy with which a groove can be made on existing machinery which is precisely parallel to the axis of the printing cylinder 2, 20, respectively. If the groove is made wider, more material will be required for the respective insert strips and, of course, more machining time and energy will be required to make the groove; thus, a suitable engineering compromise between ease of manufacture and assembly will readily determine the upper limit of the width of the groove.

I claim:

1. Printing plate attachment arrangement to attach a thin, flexible printing plate (4) to a plate cylinder (1, 20) of a printing machine, wherein, the plate cylinder is provided with two axially extending slits (18, 30) in its circumference to receive respective end portions of the printing plate, comprising, in accordance with the invention, a groove (3, 21) formed in the circumference of the plate cylinder (1, 20) at an acute angle to the surface of said cylinder and bounded by groove walls in the cylinder, the groove having a width (a) which is larger than twice the thickness (b) of the printing plate;

an insert strip (5, 23) retained in and axially movable within the groove (21) of the plate cylinder (20), said insert strip having a guide portion (6, 24) located in the end region of the strip adjacent the inner zone (7, 32) of the groove, and engaging the walls of the groove, an engagement and separating wall portion (9, 25), which is thinner than the guide portion, for receiving the end portions of a printing plate and defining the slits (18, 30) between the walls of the cylinder forming the groove and the engagement or separating wall portion of the insert strip; and register elements (13, 31) secured to and projecting from the engagement or separating wall portion (9,25) of the insert strip and securing end portions of said printing plate in a desired axial position against axial slippage within said groove.

2. Arrangement according to claim 1, wherein the guide portion (6) of the strip (5) is adhesively attached to the adjacent side walls (7) and the bottom (8) of the groove (3).

3. Arrangement according to claim 1, further including register elements (13, 31) secured to the engagement or separating wall portion (9, 25) of the insert strip.

4. Arrangement according to claim 3, wherein the register elements comprise pins (13);

and wherein the printing plate (4) is formed with notches (15) engaging said pins.

5. Arrangement according to claim 1, wherein the insert strip (23) is axially shiftable within the groove (21) of the plate cylinder (20).

6. Arrangement according to claim 5, wherein the guide portion (24) of the insert strip is formed with gear teeth facing the inside of the groove;

and a worm (27) axially and rotatably retained within the cylinder (20) positioned for engagement with the teeth of the insert strip, upon rotation of the worm, axial shift of the insert strip.

7. Arrangement according to claim 6, including abutment strips (31) extending laterally from the engagement or separating wall portion of the insert strip, the abutment strips (31) retaining the end portions of the printing plate (4) therebetween to provide for axial shifting of the printing plate upon rotation of the worm (27).

8. Arrangement according to claim 1, wherein the width (a) of the groove is between about 6 to 10 times the thickness (b) of the printing plate.

9. Arrangement according to claim 1, wherein the width (a) of the groove is about 8 times the thickness (b) of the printing plate.

10. Arrangement according to claim 1, wherein the width (a) of the groove is at least about 6 times the thickness (b) of the printing plate.

11. Printing plate attachment arrangement to attach a thin, flexible printing plate (4) to a plate cylinder (1, 20) of a printing machine, wherein, the plate cylinder is provided with two axially extending slits (18, 30) in its circumference to receive respective end portions of the printing plate, comprising, in accordance with the invention, a groove (3, 21) formed in the circumference of the plate cylinder (1, 20) and bounded by groove walls in the cylinder, the groove having a width (a) which is larger than twice the thickness (b) of the printing plate;

an insert strip (5, 23) retained in and axially movable within the groove (21) of the plate cylinder (20), said insert strip having a guide portion (6, 24) located in the end region of the strip adjacent the inner zone (7, 32) of the groove, and engaging the walls of the groove, an engagement and separating wall portion (9, 25), which is thinner than the guide portion, for receiving the end portions of a printing plate and defining the slits (18, 30) between the walls of the cylinder forming the groove and the engagement or separating wall portion of the insert strip; and register elements (13, 31) formed as longitudinally extending abutment strips (31), laterally projecting from said engagement or separating wall portion (9,25) of the insert strip (5, 23).

* * * * *